US011840074B2

(12) United States Patent
Kato

(10) Patent No.: US 11,840,074 B2
(45) Date of Patent: Dec. 12, 2023

(54) PRINTING APPARATUS AND PRINTING METHOD

(71) Applicant: CANON KABUSHIKI KAISHA, Tokyo (JP)

(72) Inventor: Minako Kato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 466 days.

(21) Appl. No.: 17/149,250

(22) Filed: Jan. 14, 2021

(65) Prior Publication Data

US 2021/0129523 A1 May 6, 2021

Related U.S. Application Data

(63) Continuation of application No. PCT/JP2019/027874, filed on Jul. 16, 2019.

(30) Foreign Application Priority Data

Jul. 25, 2018 (JP) ..... 2018-139504

(51) Int. Cl.
*B41J 2/005* (2006.01)
*B41J 2/21* (2006.01)
(Continued)

(52) U.S. Cl.
CPC ..... *B41J 2/0057* (2013.01); *B41J 2/01* (2013.01); *B41J 2/2056* (2013.01); *B41J 2/21* (2013.01);
(Continued)

(58) Field of Classification Search
CPC ... B41J 2/01; B41J 2/211; B41J 2/1433; B41J 2/17; B41J 2/17593; B41J 2/2107;
(Continued)

(56) References Cited

U.S. PATENT DOCUMENTS

2005/0110856 A1* 5/2005 Mouri ..... B41J 2/0057 347/103
2009/0225144 A1* 9/2009 Kusunoki ..... B41J 2/14233 347/102
(Continued)

FOREIGN PATENT DOCUMENTS

JP 2009-190394 A 8/2009
JP 5085893 B2 11/2012
(Continued)

*Primary Examiner* — Manish S Shah
(74) *Attorney, Agent, or Firm* — Canon U.S.A., Inc., IP Division

(57) ABSTRACT

A printing apparatus includes a printing unit discharging a plurality of different pigmented inks onto a transfer member and forming an ink image, a processing unit performing processing such that each of the pigmented inks applied on the transfer member forms a layer, and a transfer unit transferring the ink image from the transfer member onto the printing medium conveyed by the conveyance unit. The pigmented inks include cyan, magenta, yellow, and black inks as pigmented inks of four basic colors, and at least one pigmented ink different from the pigmented inks of basic colors. A first ink at least one of the pigmented inks of the basic colors is applied onto the transfer member after a second ink is applied. The second ink is the pigmented ink different from the pigmented inks of the basic colors and has a color material density lower than that of the first ink.

11 Claims, 10 Drawing Sheets

(51) Int. Cl.
*B41J 2/205* (2006.01)
*B41J 2/01* (2006.01)
*B41J 25/00* (2006.01)

(52) U.S. Cl.
CPC ..... *B41J 2/2146* (2013.01); *B41J 2002/012* (2013.01); *B41J 2025/008* (2013.01)

(58) Field of Classification Search
CPC ..... B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 2/1623; B41J 2202/00; B41J 2202/03; B41J 2/14201; B41J 2/045; B41J 11/0015; B41J 11/002; B41J 2/04581; B41J 2/055; B41J 2/16538; B41J 2002/16502; B41J 29/02; B41J 2/17513; B41J 2/17509; B41J 29/13; B41J 2/17553; B41J 2/1606; B41J 2/1642; B41J 2/1609; B41J 2/164; B41J 2/162; B41J 2/161; B41J 2/19; B41J 15/04; B41J 25/001; B41J 25/34; B41J 25/003; B41J 25/312; B41J 2025/008; B41J 2202/21; B41J 2/17596; B41J 2/16508; B41J 2/1652; B41J 2/175; B41J 2/17563; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; C09D 11/106; C09D 11/326; C09D 11/107; C09D 11/03; C09D 11/037; C09D 11/033; B41M 5/0011; B41M 5/0017; B41M 5/0023; B41M 5/0047; B41M 7/00; B41M 7/0072; B41M 5/52; B41M 5/5218; B41M 5/5227
See application file for complete search history.

(56) References Cited

U.S. PATENT DOCUMENTS

| | | | | |
|---|---|---|---|---|
| 2009/0237442 | A1* | 9/2009 | Yamanobe | C09D 11/54 347/21 |
| 2012/0019583 | A1* | 1/2012 | Fujimoto | B41J 2/2107 347/15 |
| 2014/0247307 | A1* | 9/2014 | Azuma | B41J 11/0015 347/43 |
| 2019/0315129 | A1* | 10/2019 | McConville | B41J 2/2114 |
| 2020/0036865 | A1* | 1/2020 | Tanaka | H04N 1/4015 |

FOREIGN PATENT DOCUMENTS

| | | | |
|---|---|---|---|
| JP | 2015-58709 | A | 3/2015 |
| JP | 2017-19187 | A | 1/2017 |
| JP | 2019-14234 | A | 1/2019 |
| JP | 2019-14235 | A | 1/2019 |
| WO | 2004/011263 | A1 | 2/2004 |

* cited by examiner

PRINTING APPARATUS AND PRINTING METHOD

CROSS-REFERENCE TO RELATED APPLICATIONS

This application is a Continuation of International Patent Application No. PCT/JP2019/027874, filed Jul. 16, 2019, which claims the benefit of Japanese Patent Application No. 2018-139504, filed Jul. 25, 2018, both of which are hereby incorporated by reference herein in their entirety.

BACKGROUND OF THE INVENTION

Field of the Invention

The present invention relates to a printing apparatus and a printing method.

Background Art

A large number of printing apparatuses using an inkjet technique have been proposed. Examples of the technique include a direct-drawing method for directly applying ink onto a printing medium, and a transfer method for transferring ink applied on a transfer member onto a printing medium. PTL 1 discusses a printing apparatus having an intermediate transfer member that carries an ink image, an ink discharge unit, and a transfer unit that transfers the ink image onto a printing medium.

In contrast, a printing apparatus having the following configuration has heretofore been proposed. That is, the printing apparatus uses not only inks of three primary colors of cyan (C), magenta (M), and yellow (Y), which are basic color inks for printing, but also light color inks, which are similar colors as the basic colors and have densities different from those of the basic colors, or inks of special colors, such as orange and green, which have different hues so as to obtain a high-quality image.

In the printing apparatus having the configuration in which inks are sequentially applied onto the transfer member and are transferred onto a printing medium as discussed in PTL 1, an ink layer structure is formed on the printing medium. In such a layer structure, a mixture of different inks, which is observed in an apparatus using a dye direct-drawing method, is less likely to occur, and thus color development of an image having the layer structure is different from color development of an image formed by the direct-drawing method. In particular, the layer structure formed of ink using a color material with a large grain size, such as pigment, is important to obtain desired color development properties. In particular, basic color inks of CMY (C, M, and Y) having substantially the same color material density are often used in terms of color balance. However, the density and hue of ink to be used in addition to the basic color inks to improve the chroma or to improve the graininess of images are greatly different from those of the basic color inks. To fully exert the effect of the added ink to increase the image quality, it is important to mix the basic color inks and the added ink in a balanced way.

CITATION LIST

Patent Literature

PTL 1: Japanese Patent No. 5085893

SUMMARY OF THE INVENTION

The present invention has been made to solve the above-described issues. The present invention is directed to satisfactorily developing colors of an image to be formed by forming a plurality of ink layers in a balanced way.

Other features and advantageous effects of the present invention will become apparent from the following description with reference to the accompanying drawings. In the accompanying drawings, the same or similar components are denoted by the same reference numerals.

Further features of the present invention will become apparent from the following description of exemplary embodiments with reference to the attached drawings.

BRIEF DESCRIPTION OF THE DRAWINGS

The accompanying drawings are included in the specification, constitute a part thereof, and illustrate exemplary embodiments of the present invention. The accompanying drawings are used together with the description to explain the exemplary embodiments of the present invention.

DESCRIPTION OF THE EMBODIMENTS

Preferred exemplary embodiments of the present invention will be described below.

First Embodiment

<Printing System>

Figure 1:
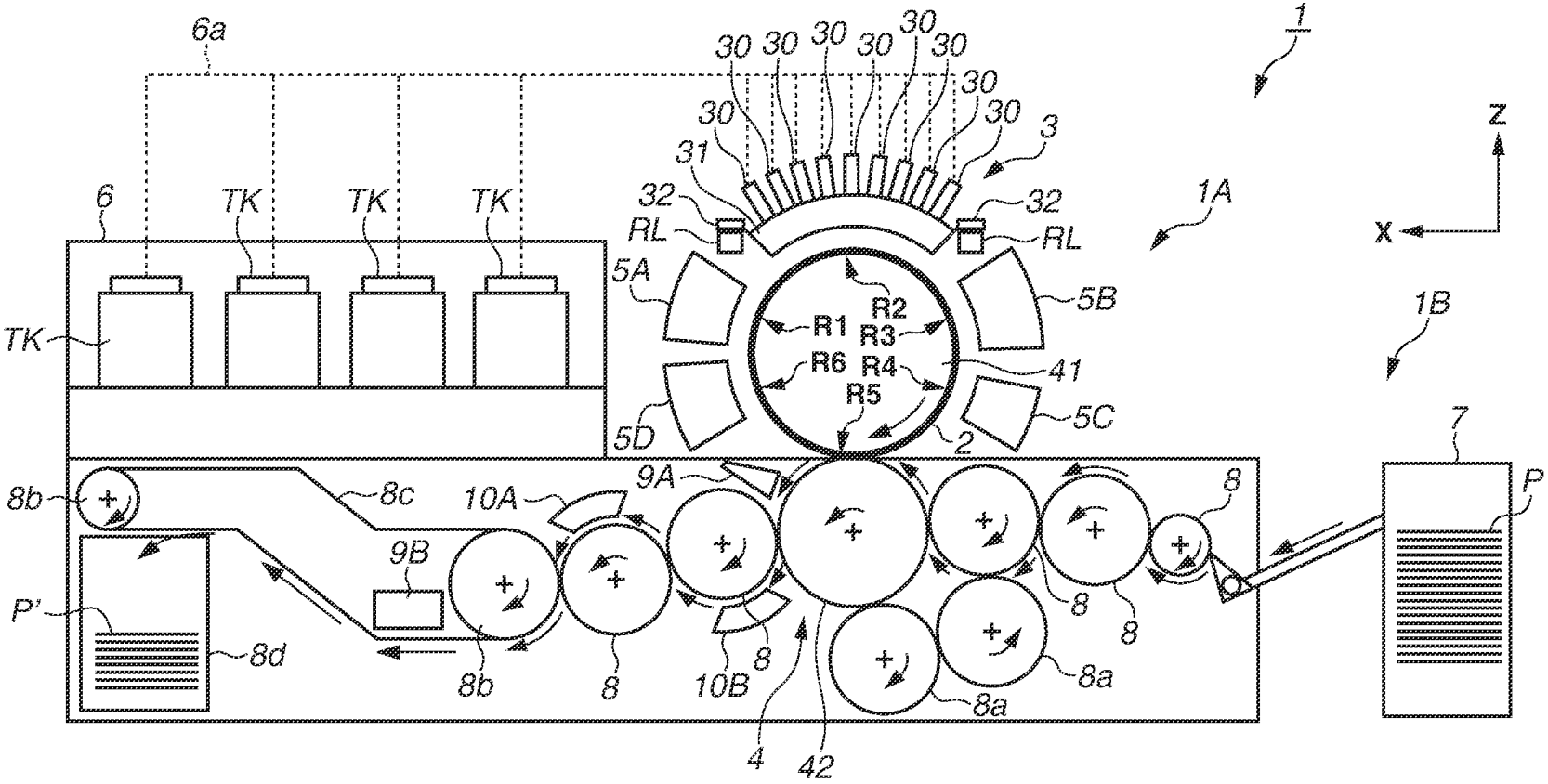
FIG. 1 illustrates a printing system.

FIG. 1 is a front view schematically illustrating a printing system 1 according to a first exemplary embodiment of the present invention. The printing system 1 is a sheet-fed inkjet printer that produces a printed product P' by transferring an ink image onto a printing medium P through a transfer member 2. The printing system 1 includes a printing apparatus 1A and a conveyance apparatus 1B. In the present exemplary embodiment, an X-direction, a Y-direction, and a Z-direction indicate a width direction (full-length direction), a depth direction, and a height direction, respectively, of the printing system 1. The printing medium P is conveyed in the X-direction.

<Printing Apparatus>

The printing apparatus 1A includes a printing unit 3, a transfer unit 4, peripheral units 5A to 5D, and a supply unit 6.

<Printing Unit>

Figure 2:
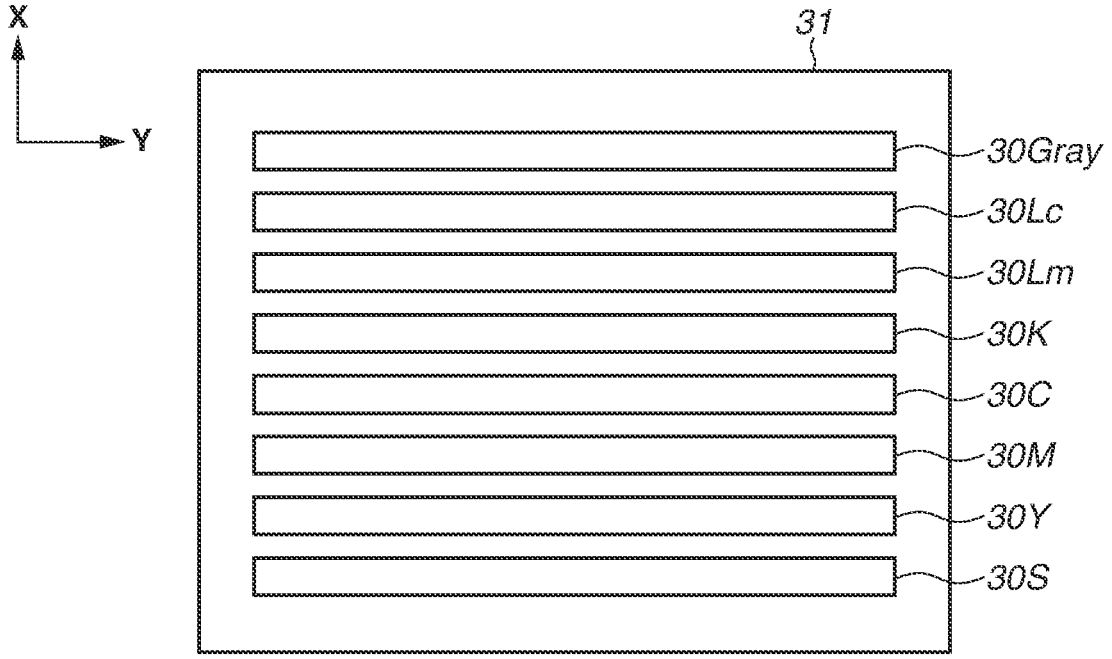
FIG. 2 illustrates a printhead.

The printing unit 3 includes a plurality of printheads 30 and a carriage 31. FIG. 2 is a schematic diagram illustrating the configuration of each printhead 30 when the carriage 31 is viewed in the direction of the transfer member 2 from the top of the printing apparatus 1A. In the present exemplary embodiment, the printing unit 3 includes eight printheads 30. The carriage 31 includes a head 30K for discharging black (K) ink, a head 30C for discharging cyan (C) ink, a head 30M for discharging magenta (M) ink, and a head 30Y for discharging yellow (Y) ink. The cartridge 31 further includes a head 30Lc for discharging light cyan (Lc) ink, which has the same hue as cyan and a density lower than the cyan ink, a head 30Lm for discharging light magenta (Lm) ink, which has the same hue as magenta and a density lower than the magenta ink, and a head 30Gray for discharging gray (Gray) ink, which has a density lower than the black ink. These inks are pigmented inks each including a pigment color material. Further, ink (e.g., clear ink) containing no color material may also be discharged. The clear ink can be used, for example, to improve glossiness of images. The clear ink can also be used to reduce the glossiness of images, or to obtain matte images. Aside from the glossiness control, image transfer liquid can be used for improving transfer properties of images to be transferred from the transfer member 2 onto the printing medium P. The image transfer liquid is formed on an ink layer formed on the transfer member 2, and contacts the printing medium P, thereby improving the transfer properties. Thus, a printhead for applying the image transfer liquid is disposed at a downstream side of the printheads for applying various types of inks. In the present exemplary embodiment, the carriage 31 includes a head 30S for discharging the image transfer liquid. The printheads 30 are disposed in the carriage 31. The printheads 30 discharge ink onto the transfer member 2, which is a discharged medium, and form an ink image as a print image on the transfer member 2. As described above, in the layout of the printheads illustrated in FIG. 2, light cyan ink, light magenta ink, and gray ink are applied before black ink, cyan ink, magenta ink, and yellow ink, which are basic color inks, are applied.

In the present exemplary embodiment, each printhead 30 is a full-line head extending in the Y-direction, and nozzles are arranged in a range that covers the width of an image printing area of an available maximum-size printing medium. A lower surface of each printhead 30 includes an ink discharge surface in which the nozzles are opened. The ink discharge surface faces the surface of the transfer member 2 through a small gap (e.g., several mm). In the present exemplary embodiment, the transfer member 2 is configured to move circularly on a circular path. The plurality of printheads 30 is radially arranged, accordingly.

Each nozzle is provided with a discharge element. The discharge element is, for example, an element that generates a pressure inside the nozzle and discharges ink in the nozzle. A known technique for an inkjet head of an inkjet printer can be applied for the discharge element. Examples of the discharge element include an element that forms air bubbles by causing film boiling in ink using an electro-thermal transducer to thereby discharge ink, an element that discharges ink using an electro-mechanical transducer, and an element that discharges ink using static electricity. In terms of high-speed printing with high density, a discharge element using an electro-thermal transducer can be used.

The carriage 31 supports the plurality of printheads 30. An end of each printhead 30 on the ink discharge surface side thereof is fixed to the carriage 31. This makes it possible to more precisely maintain the gap between the ink discharge surface and the surface of the transfer member 2.

A rear portion of the printing system 1 is provided with a recovery unit (not illustrated). The recovery unit includes a mechanism for recovering the discharge performance of each printhead 30. Examples of the mechanism include a cap mechanism for capping the ink discharge surface of each printhead 30, a wiper mechanism for wiping the ink discharge surface, and a suction mechanism that sucks the ink in each printhead 30 from the ink discharge surface under negative pressure.

<Transfer Unit>

The transfer unit 4 will now be described with reference to FIG. 1. The transfer unit 4 includes a transfer cylinder 41 and an impression cylinder 42. These cylinders are rotary members that are rotated about a rotation axis in the Y-direction, and have a cylindrical outer peripheral surface. In FIG. 1, each arrow illustrated in the figures representing the transfer cylinder 41 and the impression cylinder 42 indicates a rotation direction. The transfer cylinder 41 is rotated clockwise and the impression cylinder 42 is rotated counterclockwise.

The transfer cylinder 41 is a support member that supports the transfer member 2 on the outer peripheral surface of the transfer cylinder 41. The transfer member 2 is continuously or intermittently provided in a circumferential direction on the outer peripheral surface of the transfer cylinder 41. If the transfer member 2 is continuously provided, the transfer member 2 is formed in an endless band shape. If the transfer member 2 is intermittently provided, the transfer member 2 is divided into a plurality of segments with ends, and the segments can be arranged in an arcuate shape at regular pitches on the outer peripheral surface of the transfer cylinder 41.

The rotation of the transfer cylinder 41 allows the transfer member 2 to circularly move on a circular path. Depending on the rotation phase of the transfer cylinder 41, the area of the transfer member 2 can be divided into the following areas: a pre-discharge processing area R1, a discharge area R2, post-discharge processing areas R3 and R4, a transfer area R5, and a post-transfer processing area R6. The transfer member 2 circularly passes through these areas.

The pre-discharge processing area R1 is an area in which pre-processing is performed on the transfer member 2 before ink is discharged by the printing unit 3, and processing is performed by the peripheral unit 5A. In the present exemplary embodiment, reaction liquid is applied in the processing. The discharge area R2 is a formation area in which the printing unit 3 discharges ink onto the transfer member 2 and an ink image is formed. The printing unit 3 discharges ink and forms an ink image during a period in which the image formation area of the transfer member 2 passes once below the printing unit 3. The post-discharge processing areas R3 and R4 are processing areas in which processing is performed on the ink image after ink is discharged. The post-discharge processing area R3 is an area in which processing is performed by the peripheral unit 5B. The post-discharge processing area R4 is an area in which processing is performed by the peripheral unit 5C. The transfer area R5 is an area in which the ink image formed on the transfer member 2 by the transfer unit 4 is transferred onto the printing medium P. The post-transfer processing area R6 is an area in which post processing is performed on the transfer member 2 after the ink image is transferred, and processing is performed by the peripheral unit 5D.

The outer peripheral surface of the impression cylinder 42 is brought into pressure contact with the transfer member 2. The outer peripheral surface of the impression cylinder 42 is provided with at least one grip mechanism for holding a leading edge of the printing medium P. A plurality of grip mechanisms may be provided at a distance in the circumferential direction of the impression cylinder 42. When the printing medium P passes through a nip portion between the impression cylinder 42 and the transfer member 2 while the printing medium P is brought into close contact with the outer peripheral surface of the impression cylinder 42 and conveyed, the ink image is transferred onto the transfer member 2.

<Peripheral Units>

The peripheral units 5A to 5D are arranged in the vicinity of the transfer cylinder 41. In the present exemplary embodiment, the peripheral units 5A to 5D correspond to an application unit, an absorption unit, a heating unit, and a cleaning unit in this order.

The application unit 5A is a mechanism for applying reaction liquid onto the transfer member 2 before ink is discharged by the printing unit 3. The reaction liquid contains components to increase the viscosity of ink. The phrase "increase the viscosity of ink" used herein means that an increase in the viscosity of ink is observed when the color material, resin, or the like constituting ink contacts the components and thereby causing chemical reaction or physical absorption. The case of increasing the viscosity of ink includes not only a case where an increase in the viscosity of the entire ink is observed, but also a case where the viscosity is locally increased due to aggregation of some of the components, such as the color material or resin, which constitute ink.

Examples of the mechanism for applying reaction liquid include a roller, a printhead, a dye coating apparatus (dye coater), and a blade coating apparatus (blade coater). If the reaction liquid is applied onto the transfer member 2 before ink is discharged onto the transfer member 2, the ink that has reached the transfer member 2 can be fixed immediately. This makes it possible to suppress a bleeding phenomenon in which adjacent inks are mixed together.

The absorption unit 5B is a mechanism for absorbing liquid components from the ink image formed on the transfer member 2 before the ink image is transferred. By reducing the liquid components in the ink image, for example, bleeding occurring on an image to be printed on the printing medium P can be suppressed. From a different viewpoint, the reduction of the liquid components can be expressed as concentration of ink constituting the ink image formed on the transfer member 2. The "concentration of ink" means that the ratio of solid contents, such as the color material or resin contained in the ink, to liquid components increases due to a decrease of the liquid components contained in the ink.

The absorption unit 5B includes, for example, a liquid absorption member that contacts the ink image to reduce the amount of liquid components contained in the ink image. The liquid absorption member may be formed on the outer peripheral surface of the roller. Alternatively, the liquid absorption member may be formed in an endless sheet shape and configured to cyclically move. In terms of protection of the ink image, the liquid absorption member may be moved in synchronization with the transfer member 2 by setting the speed of movement of the liquid absorption member to be equal to the peripheral speed of the transfer member 2.

The liquid absorption member may include a porous body that contacts the ink image. To prevent the ink solid content from adhering to the liquid absorption member, the pore size of the porous body on the surface in contact with the ink image may be less than or equal to 10 μm. The pore size refers to an average diameter. The pore size can be measured by a known method, such as a mercury penetration method, a nitrogen adsorption method, or a scanning electron microscope (SEM) image observation. The liquid components are not particularly limited as long as the liquid components have no definite shape, have fluidity, and have a substantially constant volume. Examples of the liquid components include water and organic solvent, which are contained in ink or reaction liquid.

The heating unit 5C is a mechanism for heating the ink image formed on the transfer member before the ink image is transferred. When the ink image is heated, resin contained in the ink image is melted, which improves the transfer properties on the printing medium P. The heating temperature can be set to more than or equal to a minimum film forming temperature (MFT) of resin. The MFT can be measured by any apparatus in compliance with a generally known method, such as Japanese Industrial Standards (JIS) K 6828-2: 2003, or International Organization for Standardization (ISO) 2115: 1996. In terms of transfer properties and image fastness properties, the heating temperature may be higher than the MFT by 10° C. or more, or may be higher than the MFT by 20° C. or more. As the heating unit 5C, for example, various lamps, such as an infrared lamp, or known heating devices, such as a hot-air fan, can be used. In terms of heating efficiency, an infrared heater can be used.

The cleaning unit 5D is a mechanism for cleaning the surface of the transfer member 2 after the transfer. The cleaning unit 5D removes, for example, ink remaining on the surface of the transfer member 2, and dust on the surface of the transfer member 2. For the cleaning unit 5D, the following known methods can be appropriately used: a method for bringing a porous member into contact with the transfer member 2, a method for rubbing the surface of the transfer member with a brush, a method for scraping off the surface of the transfer member 2 with a blade, and other methods. As a cleaning member used for cleaning, a known shape, such as a roller shape or a web shape, can be used.

As described above, the present exemplary embodiment includes the following peripheral units: the application unit 5A, the absorption unit 5B, the heating unit 5C, and the cleaning unit 5D. In addition, a cooling function for the transfer member 2 may be added to some of the peripheral units, or a cooling unit may be added. In the present exemplary embodiment, the temperature of the transfer member 2 may be increased due to heat of the heating unit 5C. When the temperature of the ink image exceeds the boiling point of water a prime ink solvent after ink is discharged onto the transfer member 2 by the printing unit 3, the absorption performance for absorbing liquid components by the absorption unit 5B may deteriorate. The transfer member 2 is cooled to maintain the temperature of the discharged ink at a temperature lower than the boiling point of water, thereby making it possible to maintain the absorption performance for absorbing liquid components.

The cooling unit may be an air-blowing mechanism for blowing air toward the transfer member 2, or a mechanism for bringing a member (e.g., a roller) into contact with the transfer member 2 and cooling the member by air cooling or water cooling. Alternatively, the cooling unit may be a mechanism for cooling the cleaning member of the cleaning unit 5D. Cooling may be performed during a period after the transfer and before application of the reaction liquid.

<Supply Unit>

The supply unit 6 is a mechanism for supplying ink to each printhead 30 of the printing unit 3. The supply unit 6 may be provided on the rear side of the printing system 1. The supply unit 6 includes accumulation portions TK for accumulating ink for each type of ink. Each accumulation portion TK may include a main tank and a sub-tank. Each accumulation portion TK and each printhead 30 communicate with each other through a flow channel 6*a*, and ink is supplied from each accumulation portion TK to each printhead 30. The flow channel 6*a* may be a flow channel for circulating ink between each accumulation portion TK and each printhead 30, and the supply unit 6 may include a pump or the like for circulating ink. A degassing mechanism for removing air bubbles from ink may be provided in the middle of the flow channel 6*a* or on the accumulation portion TK. In the middle of the flow channel 6*a* or on the accumulation portion TK, a valve for adjusting an ink fluid pressure and an atmospheric pressure may be provided. The height of each of the accumulation portions TK and the printheads 30 in the Z-direction may be designed such that an ink liquid level in each accumulation portion TK is located at a position lower than the ink discharge surface of each printhead 30.

<Conveyance Apparatus>

The conveyance apparatus 1B is an apparatus that feeds the printing medium P to the transfer unit 4 and discharges the printed product P' on which the ink image is transferred from the transfer unit 4. The conveyance apparatus 1B includes a feed unit 7, a plurality of conveyance cylinders 8 and 8*a*, two sprockets 8*b*, a chain 8*c*, and a collecting unit 8*d*. In FIG. 1, an arrow in each figure representing a component of the conveyance apparatus 1B indicates the rotation direction of the component, and an arrow on the outside of each figure representing a component indicates a conveyance path for the printing medium P or the printed product P'. The printing medium P is conveyed from the feed unit 7 to the transfer unit 4, and the printed product P' is conveyed from the transfer unit 4 to the collecting unit 8*d*. A side where the feed unit 7 is located in the conveyance direction may be referred to as an upstream side, and a side where the collecting unit 8*d* is located in the conveyance direction may be referred to as a downstream side.

The feed unit 7 includes a stacking portion on which a plurality of printing media P is stacked, and a feed mechanism for feeding the printing media P one by one from the staking portion to the conveyance cylinder 8 located at the uppermost stream side. The conveyance cylinders 8 and 8*a* are rotary members that rotate about the rotation axis in the Y-direction. These cylinders include a cylindrical outer peripheral surface. The outer peripheral surface of each of the conveyance cylinders 8 and 8*a* is provided with at least a grip mechanism for holding a leading edge of the printing medium P (or the printed product P'). A gripping operation and a releasing operation for each grip mechanism are controlled such that the printing medium P is delivered between the adjacent conveyance cylinders.

<Control Unit>

Figure 3:
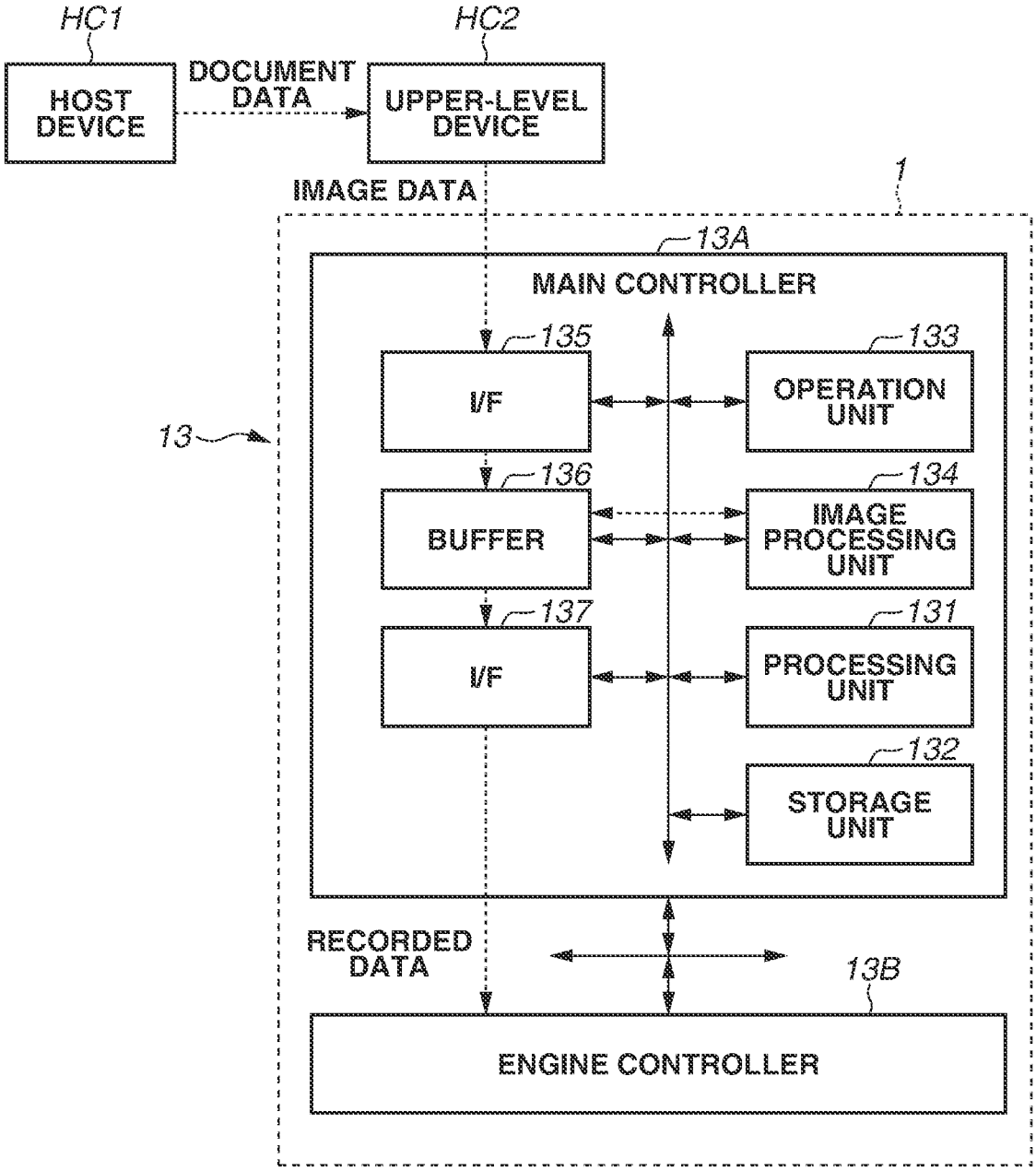
FIG. 3 is a block diagram illustrating a control system of the printing system.

Next, a control unit of the printing system 1 will be described. FIG. 3 is a block diagram illustrating a control unit 13 of the printing system 1. The control unit 13 is communicably connected to an upper-level device (DFE) HC2, and the upper-level device HC2 is communicably connected to a host device HC1.

The host device HC1 generates or stores document data based on which a print image is formed. The document data is generated in, for example, an electronic file format, such as a document file or an image file. The document data is transmitted to the upper-level device HC2. The upper-level device HC2 converts the received document data into a data format (e.g., red, green, and blue (RGB) data representing image in RGB format) that can be used by the control unit 13. The converted data is transmitted as image data from the upper-level device HC2 to the control unit 13, and the control unit 13 starts a printing operation based on the received image data.

In the present exemplary embodiment, the control unit 13 is roughly divided into a main controller 13A and an engine controller 13B. The main controller 13A includes a processing unit 131, a storage unit 132, an operation unit 133, an image processing unit 134, a communication interface (I/F) 135, a buffer 136, and a communication I/F 137.

The processing unit 131 a processor, such as a central processing unit (CPU), executes programs stored in the storage unit 132, and controls the overall operation of the main controller 13A. The storage unit 132 is a storage device, such as a random access memory (RAM), a read-only memory (ROM), a hard disk, or a solid state drive (SSD). The storage unit 132 stores programs to be executed by the CPU 131 and data, and provides a work area for the CPU 131. The operation unit 133 is, for example, an input device, such as a touch panel, a keyboard, or a mouse. The operation unit 133 receives an instruction from a user.

Figure 4:
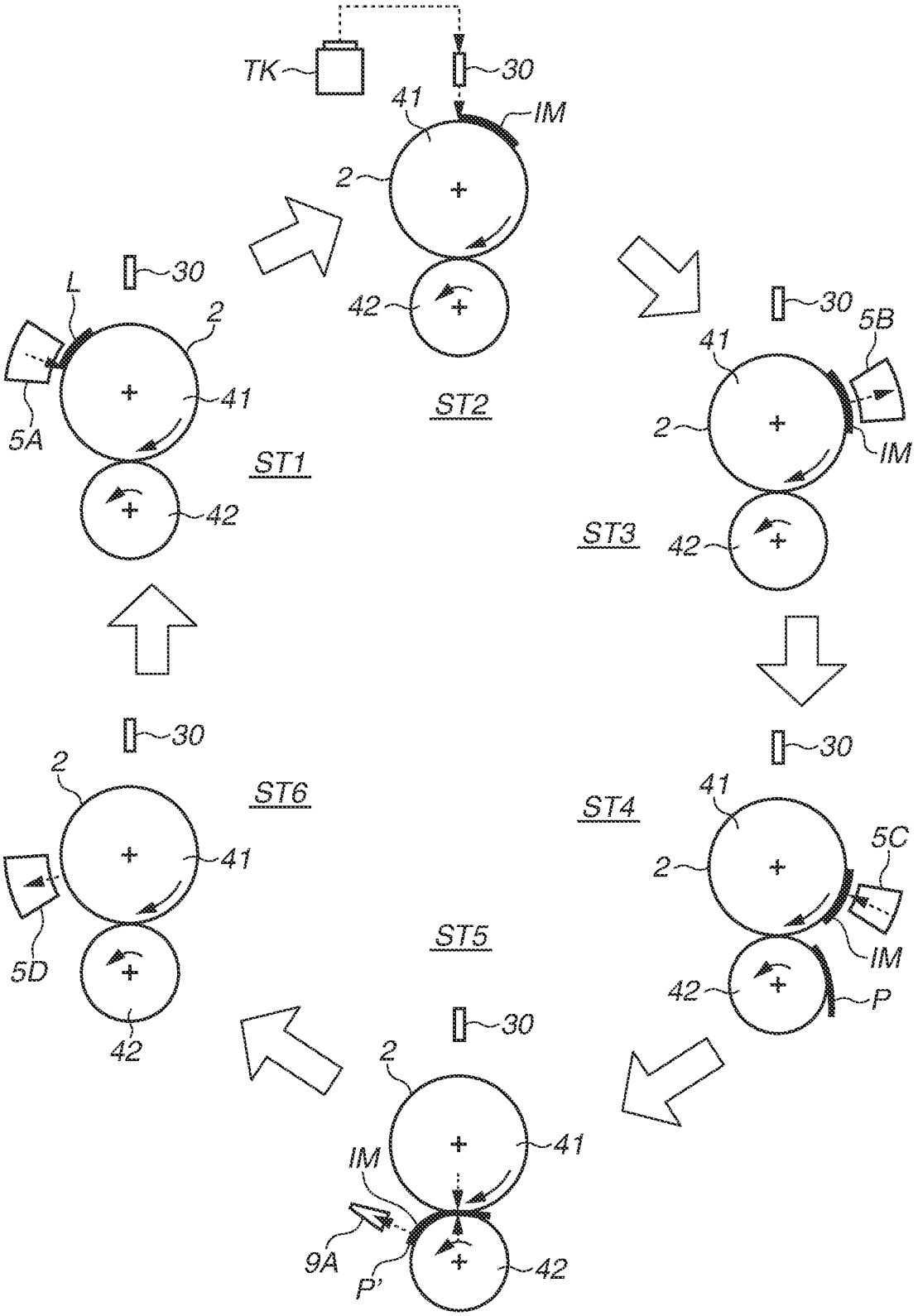
FIG. 4 illustrates an operation example of the printing system.

The image processing unit 134 is, for example, an electronic circuit having an image processing processor. The buffer 136 is, for example, a RAM, a hard disk, or an SSD. The communication I/F 135 communicates with the upper-level device HC2. The communication I/F 137 communicates with the engine controller 13B. In FIG. 4, a dashed-line arrow indicates an example of processing flow of image data. The image data received from the upper-level device HC2 via the communication I/F 135 is stored in the buffer 136. The image processing unit 134 reads out image data from the buffer 136, performs predetermined image processing on the read image data, and stores the processed data in the buffer 136 again. The image data after the image processing stored in the buffer 136 is transmitted from the communication I/F 137 to the engine controller 13B as printing data for a print engine. The engine controller 13B drives and controls the printing system 1 and performs an image formation operation.

Operation Example

FIG. 4 is an explanatory diagram schematically illustrating an example of a printing operation. The following processes are cyclically carried out while the transfer cylinder 41 and the impression cylinder 42 rotate. First, reaction liquid L is applied onto the transfer member 2 from the application unit 5A (state ST1). An area where the reaction liquid L is applied on the transfer member 2 moves along with the rotation of the transfer cylinder 41. When the area where the reaction liquid L is applied reaches a position below the printhead 30, ink is discharged from the printhead 30 onto the transfer member 2 (state ST2). An ink image IM is thereby formed. In this case, the discharged ink is mixed with the reaction liquid L on the transfer member 2, which promotes the color material to aggregate. The discharged ink is supplied to the printhead 30 from the accumulation portion TK of the supply unit 6.

The ink image IM on the transfer member 2 moves along with the rotation of the transfer member 2. When the ink image IM reaches the absorption unit 5B, the liquid components are absorbed from the ink image IM by the absorption unit 5B (state ST3). When the ink image IM reaches the heating unit 5C, the ink image IM is heated by the heating unit 5C and resin contained in the ink image IM melts, so that the ink image IM is formed (state ST4). In synchronization with the formation of the ink image IM, the printing medium P is conveyed by the conveyance apparatus 1B.

The ink image IM and the printing medium P reach the nip portion between the transfer member 2 and the impression cylinder 42, and the ink image IM is transferred onto the printing medium P, thereby producing the printed product P' (state ST5). After passing through the nip portion, the image printed on the printed product P' is photographed by an inspection unit 9A to inspect the printed image. The printed product P' is conveyed to the collecting unit 8*d* by the conveyance apparatus 1B.

When a portion where the ink image IM is formed on the transfer member 2 reaches the cleaning unit 5D, the portion is cleaned by the cleaning unit 5D (state ST6). When the cleaning is completed, the transfer member 2 is rotated once, and the transfer of the ink image onto the printing medium P is repeatedly performed in a procedure similar to that described above. To facilitate understanding, the present exemplary embodiment described above illustrates an example where the transfer of the ink image IM onto a single printing medium P is performed once during one rotation of the transfer member 2. However, the transfer of the ink image IM onto a plurality of printing media P can be continuously performed in one rotation of the transfer member 2.

<Ink>

Ink applied to the present exemplary embodiment will now be described.

(Color Material)

Pigment is used as a color material contained in ink applied to the present exemplary embodiment. Types of pigment that can be used as the color material are not limited. Specific examples of the pigment include inorganic pigment, such as carbon black; and organic pigment, such as azo-based pigment, phthalocyanine-based pigment, quinacridone-based pigment, isoindolinone-based pigment, imidazolone-based pigment, diketo-pyrrolo-pyrrole-based pigment, and dioxazine-based pigment. One or more than two types of these pigments can be used.

The content of pigment in ink is preferably more than or equal to 0.5 mass % and less than or equal to 15.0 mass % with respect to the total mass of ink. More preferably, the content of pigment in ink is more than or equal to 1.0 mass % and less than or equal to 10.0 mass % with respect to the total mass of ink.

(Dispersant)

As dispersant for dispersing pigment, known dispersants used for ink of inkjet printers can be used. Among the dispersants, an aqueous dispersant including a hydrophilic part and a hydrophobic part is preferably used in a structure according to the present exemplary embodiment. In particular, a pigment dispersant which includes at least a hydrophilic monomer and a hydrophobic monomer and is composed of copolymerized resin is preferably used. The monomers used herein are not particularly limited, and known monomers can be suitably used. Specific examples of hydrophobic monomers include styrene and other styrene derivatives, alkyl(meth)acrylate, and benzyl(meth)acrylate. Examples of hydrophilic monomers include acrylic acid, methacrylic acid, and maleic acid.

The acid value of each of the dispersants is preferably more than or equal to 50 mgKOH/g and less than or equal to 550 mgKOH/g. The weight-average molecular weight of each of the dispersants is preferably more than or equal to 1000 and less than or equal to 50000. A mass ratio between pigment and dispersant (pigment:dispersant) is preferably in a range from 1:0.1 to 1:3.

In the present exemplary embodiment, it is suitable to use self-dispersed pigment obtained by performing a surface modification on the pigment itself to allow the pigment to be dispersed instead of using dispersant.

(Fine Resin Particles)

Ink applied to the present exemplary embodiment may contain various types of fine particles containing no color material. Among the various types of fine particles, fine resin particles may have an advantageous effect of improvement in image quality and fixability.

A material for fine resin particles that can be used in the present exemplary embodiment is not limited, and known resin can be used. Specific examples of resin include polyolefin, polystyrene, polyurethane, polyester, polyether, polyurea, polyamide, polyvinyl alcohol, poly(meth)acrylic acid, and other salts. Specific examples of resin also include a homopolymerized product, such as alkyl poly(meth)acrylate, and polydien, or a copolymerized product obtained by polymerizing a plurality of combinations of monomers for generating the homopolymerized products. The weight-average molecular weight (Mw) of the resin is preferably in a range from 1,000 to 2,000,000. The amount of fine resin particles contained in ink is preferably more than or equal to 1 mass % and less than or equal to 50 mass %, and more preferably, more than or equal to 2 mass % and less than or equal to 40 mass %, with respect to the total mass of ink.

In the present exemplary embodiment, the fine resin particles are preferably used as fine resin particle dispersing bodies dispersed in liquid. A dispersion method is not limited, but it is preferable to use dispersing bodies of so-called self-dispersed fine resin particles. The fine resin particles are obtained by polymerizing monomers having a dissociable group or copolymerizing various types of monomers. Examples of the dissociable group include a carboxyl group, a sulfonic group, and a phosphate group. Examples of monomers having the dissociable group include acrylic acid, and methacrylic acid. It is also preferable to use dispersing bodies for so-called emulsified/dispersed fine resin particles obtained by dispersing fine resin particles by an emulsifier, in the present exemplary embodiment. As the emulsifier used in the present exemplary embodiment, known surfactants are preferably used regardless of whether the surfactants have a low molecular weight or a high molecular weight. As the surfactant, a nonionic surfactant or a surfactant having the same electric charges as those of the fine resin particles is preferably used.

The fine resin particle dispersing bodies used in the present exemplary embodiment preferably have a dispersed particle diameter in a range from 10 nm to 1000 nm, and more preferably, a dispersed particle diameter in a range from 100 nm to 500 nm.

In the case of preparing the fine resin particle dispersing bodies used in the present exemplary embodiment, it is also preferable to add various types of additives for stabilization. Examples of the additives include n-hexadecane, dodecyl methacrylate, stearyl methacrylate, chlorobenzene, dodecyl mercaptan, blue dye (bluing agent), and poly(methyl methacrylate).

(Surfactant)

Ink that can be used in the present exemplary embodiment may contain surfactant. Specific examples of the surfactant include an acetylene glycol ethylene oxide additive (Acetylenol E100 manufactured by Kawaken Fine Chemicals Co., Ltd.). The amount of surfactant in ink is preferably more than or equal to 0.01 mass % and less than or equal to 5.0 mass % with respect to the total mass of ink.

(Water and Aqueous Organic Solvent)

Ink that can be used in the present exemplary embodiment may contain, as solvent, water and/or aqueous organic solvent. Water deionized by ion exchange or the like is preferably used. The content of water in ink is preferably more than or equal to 30 mass % and less than or equal to 97 mass % with respect to the total mass of ink.

The type of aqueous organic solvent used in the present exemplary embodiment is not particularly limited, and known organic solvents can be used. Specific examples of the organic solvents include glycerin, diethylene glycol, polyethylene glycol, poly(propylene glycol), ethylene glycol, propylene glycol, butylene glycol, triethylene glycol, and thiodiglycol. The examples also include hexylene glycol, ethylene glycol monomethyl ether, diethylene glycol monomethyl ether, 2-pyrrolidone, ethanol, and methanol. A mixture of two or more organic solvents selected from the above examples may also be used.

The content of aqueous organic solvent in ink is preferably more than or equal to 3 mass % and less than or equal to 70 mass % with respect to the total mass of ink.

(Other Additives)

Ink that can be used in the present exemplary embodiment may contain not only the above-described components, but also various additives, such as pH adjuster, inhibitor, antiseptic, mildewproofing agent, antioxidant, reduction inhibitor, aqueous resin, neutralizer for aqueous resin, and viscosity adjuster.

<Reaction Liquid>

The reaction liquid contains components to increase the viscosity of ink (ink viscosity increasing components). The case of "increasing the viscosity of ink" includes a case is observed where the color material, resin, or the like, which are a part of composition constituting ink, contacts the ink viscosity increasing components to cause chemical reaction or physical adsorption thereby increasing the viscosity of whole of the ink. The case of "increasing the viscosity of ink" also includes a case where some of the components, such as the color material, constituting ink aggregate, and thereby the viscosity is locally increased. The ink viscosity increasing components are advantageous in reducing the fluidity of part of the ink and/or the composition of the ink on the discharged medium, thereby suppressing the occurrence of bleeding or beading during an image formation operation using ink. As the ink viscosity increasing components, known components, such as multivalent metal ions, organic acid, cationic polymer, and fine porous particles, can be used. Among these components, multivalent metal ions and organic acid are suitably used. The ink may preferably contain various types of ink viscosity increasing components. The content of the ink viscosity increasing components in the reaction liquid is preferably more than or equal to 5 mass % with respect to the total mass of reaction liquid.

Examples of multivalent metal ions include bivalent metal ions, such as $Ca^{2+}$, $Cu^{2+}$, $Ni^{2+}$, $Mg^{2+}$, $Sr^{2+}$, $Ba^{2+}$, and $Zn^{2+}$, and tervalent metal ions, such as $Fe^{3+}$, $Cr^{3+}$, $V^{3+}$, and $Al^{3+}$.

Examples of the organic acid include oxalic acid, polyacrylic acid, formic acid, acetic acid, propionic acid, glycolic acid, malonic, malic acid, maleic acid, ascorbic acid, levulinic acid, succinic acid, glutaric acid, and glutamic acid. The examples also include fumaric acid, citric acid, tartaric acid, lactic acid, pyrrolidone carboxylate, pyronecarboxylic acid, pyrrole-carboxylic acid, furancarboxylic acid, pyridinecarboxylic acid, coumaric acid, thiophenecarboxylic acid, nicotinic acid, oxysuccinic acid, and dioxysuccinic acid.

The reaction liquid can contain an optimum dose of water and/or low-volatile organic solvent. Water used in this case is preferably water deionized by, for example, ion exchange. The organic solvent that can be used as the reaction liquid applied to the present exemplary embodiment is not limited, and known organic solvents can be used.

The reaction liquid can be used to adjust the surface tension or viscosity by adding a surfactant or viscosity adjuster in the reaction liquid. A material to be used is not limited as long as the material can coexist with the ink viscosity increasing components. Specific examples of the surfactant to be used include an acetylene glycol ethylene oxide additive, and a perfluoroalkyl ethylene oxide additive.

In the printing system 1 described above, inks are sequentially applied onto the transfer member 2 on which the reaction liquid is coated. The inks are transferred onto a paper plane, and thereby a color material layer including a color material is formed on the paper plane.

Even in an apparatus that uses a printing medium as a discharged medium and ink discharged from each printhead is directly applied onto a printing medium without passing through the transfer member, inks are sequentially applied one type by one type to thereby form a color development layer. Each type of ink is mainly composed of a color material and a solvent. Only a small amount of solvent contained in the ink applied onto the printing medium is left on the color development layer due to volatilization or penetration of solvent into the printing medium. The color development layer is mainly composed of a color material. The color material is adsorbed in an ink adsorption layer included in an ink reception layer formed in the printing medium, or remains in a void or the like of the printing medium, thereby forming the color development layer. The color development layer varies depending on the ink or printing medium to be used, but is mainly formed in the printing medium. If the amount of the color material for forming the color development layer is small, the amount of the color material adsorbed in the adsorb layer or remains in the void of the printing medium becomes small. The thickness of the color development layer becomes small, accordingly. Thus, in such a system, when the same amount of different types of ink with different color material densities is applied, the color development layer having a thickness depending on the color material is formed. Thus, a large difference in color material densities in the color development layer is less likely to occur even if the color material densities of the inks are high or low.

In contrast, the printing apparatus 1A according to the present exemplary embodiment sequentially applies inks onto the transfer member 2 on which the reaction liquid is coated, in a pre-processing process. When the inks contact the reaction liquid, the inks aggregate. Thus, every time when inks are discharged one color by one color, an ink aggregation layer is formed, so that the inks are not mixed together. This promotes the layer formation. Further, the amount of liquid components is reduced in an absorption process. In a heating process, the ink aggregation layer obtained by melting fine resin particles is transferred onto the printing medium. The inks thereby less likely to penetrate through the printing medium, and most of the inks are left on the printing medium, which promotes the layer formation. Since the inks contain not only a color material, but also fine resin particles, the color development layer is formed of a mixture of the color material and fine resin particles. Even when the same amount of different types of ink with different color material densities is applied, a large difference in the thickness of the color development layer is less likely to occur because of the presence of fine resin particles. In other words, the color material density of the color development layer formed of ink with a low color material density is smaller than the color material density of the color development layer formed of ink with a high color material density. As described above, in the printing apparatus 1A according to the present exemplary embodiment, the color material density in the color development layer is likely to vary, if the color material densities in the inks are different. Thus, the difference in the color material density in the color development layers has a large influence on the total color development balance between an upper layer and a lower layer.

Figure 5A:
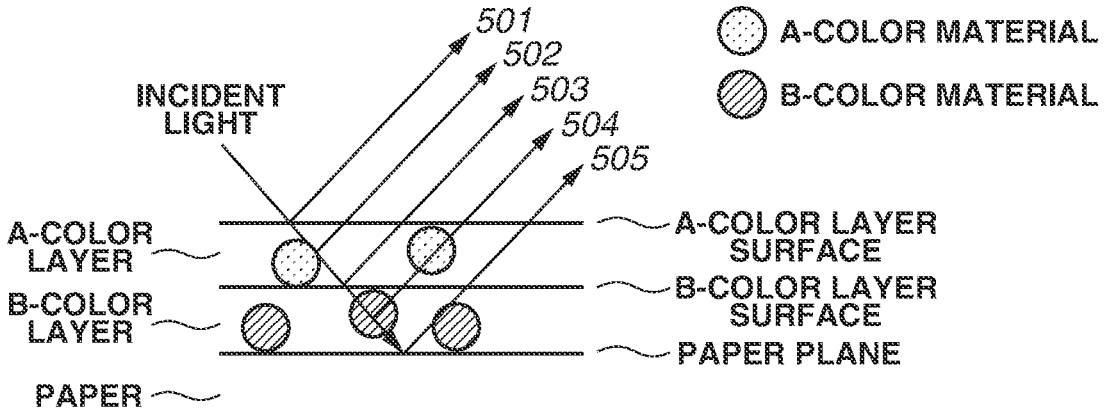
FIG. 5A illustrates an image formation state and a light reflection state.

FIG. 5A illustrates an image formation state and a light reflection state of a printed image using A-ink and B-ink. The A-ink and the B-ink each form a color development layer. These layers are stacked on a paper plane. FIG. 5A is a schematic sectional view. The A-ink includes a color material A and presents A-color. The B-ink includes a color material B and presents B-color. In this image, an A-ink color development layer and a B-ink color development layer are stacked and thus present a mixed color of A+B. The color development layer has a configuration in which a lowermost layer is paper, an intermediate layer is the B-color layer formed by B-ink, and an uppermost layer is the A-color layer formed by A-ink.

A flux of light beams reflected on each layer and an interface between layers is observed as reflected light with respect to incident light. To facilitate explanation, only the light reflected in one direction is illustrated. However, in practice, the reflected light includes specular reflection components and diffused light components, and is reflected in various directions. The reflected light contains the following five types of reflected light: reflected light 501, 502, 503, 504 and 505. The reflected light 501 is light reflected on the surface of the A-color layer, which is the surface of the image formation layer. Since the light is not absorbed by the color material, the color of the reflected light 501 is white, which is the same color as the incident light. The reflected light 502 is light reflected by the color material in the A-color layer. The reflected light 502 is absorbed/reflected at each selective wavelength depending on the A-color material. The color of the reflected light 502 corresponds to the A-color. The reflected light 503 is light reflected on the surface of the B-color layer which is an interface between the A-color layer and the B-color layer. Since the reflected light 503 is not influenced by the B-color material, the color of the reflected light 503 corresponds to the A-color. The reflected light 504 is light reflected in the B-color layer. The reflected light 503 is absorbed/reflected at each selective wavelength depending on the B-color material. The color of the reflected light 504 corresponds to the B-color. Since the incident light and output light pass through the A-color layer, the color of light output from the surface is a mixed color of the A-color and the B-color. The reflected light 505 is light reflected at an interface between the B-color layer and the paper plane. Similar to the reflected light 504, the color of the reflected light 505 is mixed color of A-color and B-color.

Figure 5B:
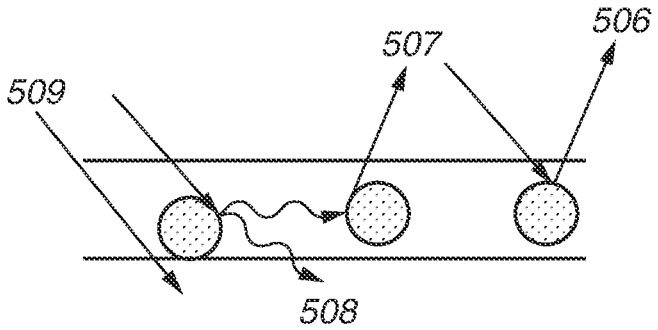
FIG. 5B illustrates an image formation state and a light reflection state.

FIG. 5B illustrates details of the reflection state in the color development layer. The color development layer is formed of a pigment color material included in ink and fine resin particles. The fine resin particles are heated in an image formation process. The fine resin particles form a substantially uniform layer including a color material. The incident light is repeatedly reflected or scattered by the color material, and is observed as reflected light of a color unique to the color material caused by the absorption at a selective wavelength by the color material. For example, light 506 is reflected by the color material and is observed as reflected light. Light 507 is scattered by the color material in the ink layer and is observed as reflected light. Light 508 is incident on a lower layer while being scattered by the color material. Light 509 reaches a lower layer without being scattered by the color material. Through the various reflection/scattering processes, part of the incident light reaches the lower layer and part of the light is observed as reflected light.

Reflected light R observed in an image formed of two layers, i.e., the A-color layer and the B-color layer, is expressed by the following formula:

$$R=R_A+T_A\cdot R_B\cdot T_A+T_A\cdot T_B\cdot R_g\cdot T_B\cdot T_A,$$

where $R_A$ is the reflectance of A-color layer, $T_A$ is the transmittance of A-color layer, $R_B$ is the reflectance of B-color layer, $T_B$ is the transmittance of B-color layer, and $R_g$ is the reflectance of paper.

As is seen from the above-described expression, the color development of the B-color is multiplied by $T_A$, i.e., the transmittance of the A-color layer. In other words, the B-color cannot be satisfactorily developed unless the transmittance of the A-color layer is increased.

The effect of scattering components is not large in a small color material, such as dye. However, the effect of scattering components is large in a pigment color material. In a color material layer with large scattering components, the transmittance decreases. In other words, if the scattering components on the upper layers are large, the transmittance decreases, which makes it difficult to satisfactorily develop the color of the lower layers. This leads to a deterioration of efficiency in, for example, color development, and color balance. To promote development of the color in the lower layers, the amount of ink for the colors in the lower layers may be increased. However, there is a limitation in the amount of ink to be held as an ink film on the transfer member 2. It is also possible to exclusively apply dots while preventing two color development layers from being stacked. However, this method is suitable for image formation with low density. In image formation with high density, e.g., halftone or more, different colors may be stacked.

Figure 6:
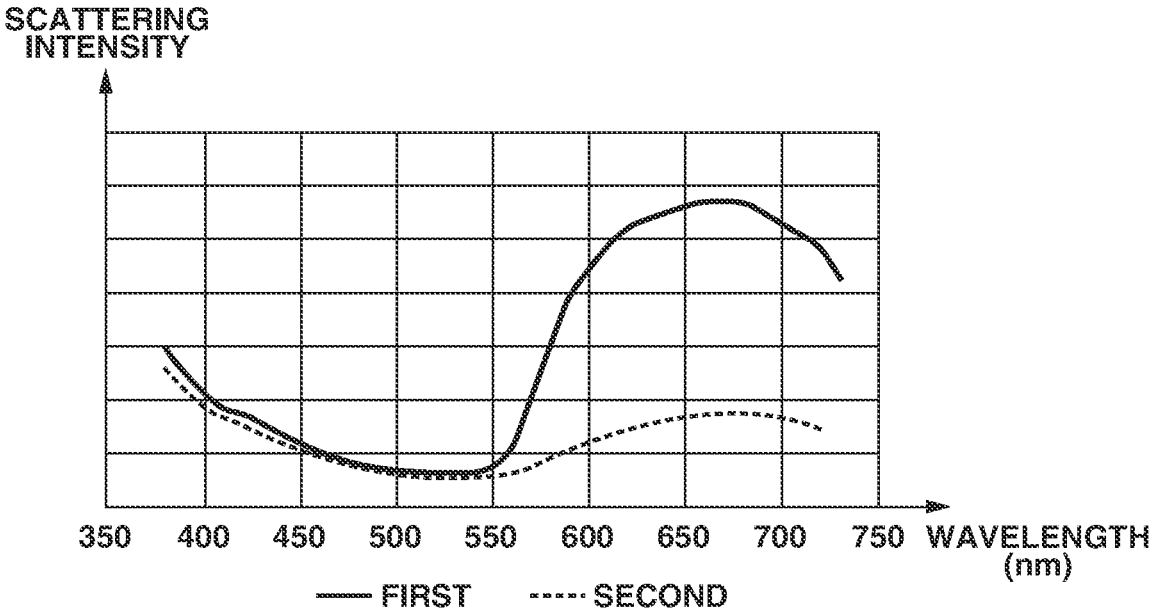
FIG. 6 illustrates a scattering intensity of two color materials.

The degree of scattering decreases as the density of the color material decreases. FIG. 6 is illustrates a scattering intensity of two cyan inks with different color material densities. The horizontal axis represents light wavelength (nm), and the vertical axis represents a scattering intensity. A first ink with a high color material density is indicated by a solid line, and a second ink with a low color material density is indicated by a dotted line. As is seen from FIG. 6, the degree of scattering of the first ink is greater than that of the second ink.

As described above, a color development layer formed using ink with a low color material density has a lower scattering intensity and a higher transmittance than those of a color development layer formed using ink with a high color material density.

In the present exemplary embodiment, among the color material layers to be stacked, the color development layer formed using ink with a low color material density is formed as the upper layer, thereby obtaining a high transmittance of the upper layer and easily obtaining the color development of the color development layer formed as the lower layer. Consequently, the color development efficiency of the color development layer formed as the lower layer increases, which leads to an improvement in color balance during color mixing. In this case, the color material densities to be compared are represented by weight %.

The color material used in the present exemplary embodiment includes light cyan (Lc), light magenta (Lm) and Gray (Lk) in addition to the basic colors of CMY and K. The colors of Lc, Lm, and Lk are collectively referred to as "light-color(s)". In many cases, light-color ink is provided to reduce the granular sense of images, and the material density of the light-color ink is reduced to make dots less conspicuous than dots of the basic colors. Specifically, CMYK color material densities are 1 to 10 weight %, and the amount of the color material of light-color ink is approximately ½ to 1/10 of the basic color of the same color type.

The color material density of light-color ink is lower than that of the basic color ink. The degree of scattering in the color development layer to be formed therefore decreases, and the transmittance of the color development layer increases. Specifically, in a case where light-color ink and basic color ink are stacked in layers the color of the color development layer to be formed using the basic color ink as the lower layer is satisfactorily developed and the colors can be mixed in a balanced way, when the color development layer to be formed using light-color ink is formed as the upper layer, thereby obtaining an excellent image.

Figure 10:
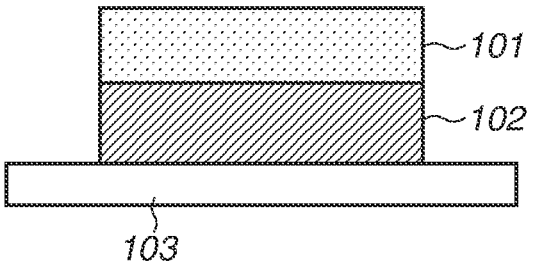
FIG. 10 is a schematic sectional view illustrating an image formation state according to the third exemplary embodiment.

As described above, in the present exemplary embodiment, the reaction liquid is coated on the transfer member. Inks are then applied onto the transfer member to form layers on the transfer member, and the ink layers are transferred onto paper. To be formed as upper layers on the paper plane, a light-color ink group (Lc, Lm, and Gray (Lk)) is applied onto the transfer member before a basic color ink group (CMY and K) is applied. By applying the above process, a lower layer 102 formed on a printing medium 103 illustrated in FIG. 10 has ink layers of any one or a plurality of the inks included in the basic color ink group (CMY and K). For example, in a case of forming an image with a cyan hue, an Lc ink layer forms the upper layer 101, and a C ink layer forms the lower layer 102. Further, for example, in a case of forming an image with a blue hue, an Lc ink layer and an Lm ink layer form the upper layer 101, and a C ink layer and an M ink layer form the lower layer 102. In this case, the Lc ink layer and the Lm ink layer are formed in the order of application in the upper layer. The same is applied to the lower layer 102.

Second Exemplary Embodiment

The first exemplary embodiment illustrates an example that uses ink having the same type of color as a basic color and a low color material density than the density of the basic color. A second exemplary embodiment illustrates a case where inks having color materials with hues different from those of the basic colors are used.

Figure 7:
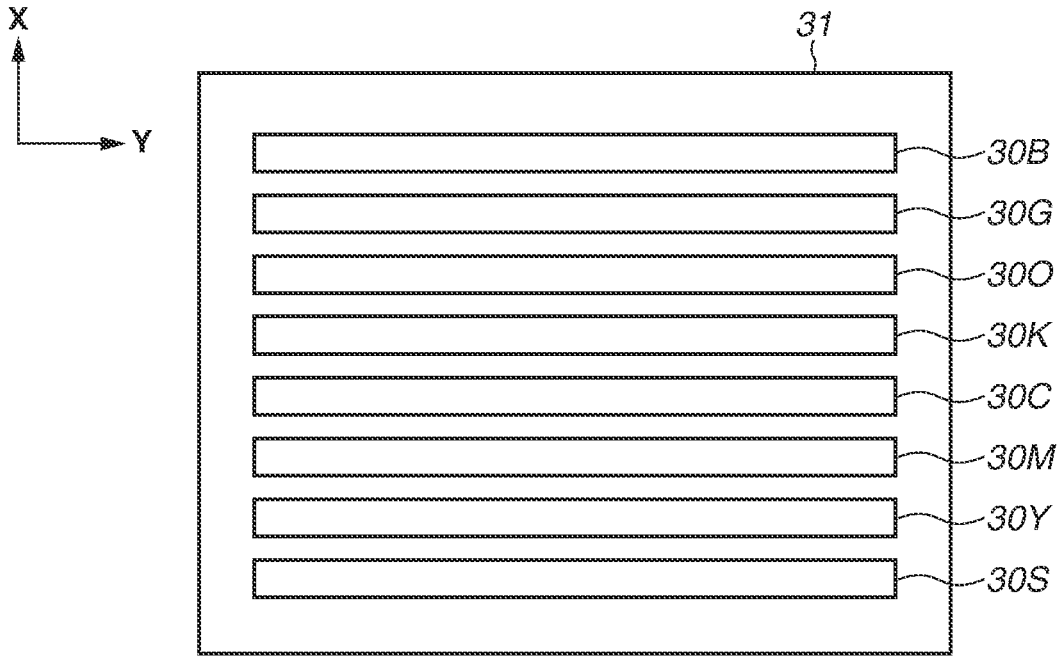
FIG. 7 illustrates a printhead according to a second exemplary embodiment.

A printing system according to the second exemplary embodiment has the same configuration as the printing system according to the first exemplary embodiment. However, the type of ink to be used in the printing system according to the second exemplary embodiment is different from the type of ink to be used in the printing system according to the first exemplary embodiment. In the present exemplary embodiment, inks of special colors with hues different from those of the basic colors are used instead of light-color inks to increase a color reproduction range. Specifically, the hues are orange (O), green (G), and blue (B), which are colors of ink with hues between the hues of basic colors CMY. The use of these colors makes it possible to increase the color gamut in a chroma direction of each color of a print image. FIG. 7 illustrates a printhead used in the present exemplary embodiment as viewed from the top of the printing apparatus, similarly to FIG. 2. Similarly to the first exemplary embodiment, the carriage 31 includes eight printheads. In addition to the head 30S for discharging the image transfer liquid, and the heads 30Y, 30M, 30C, and 30K for discharging the basic color inks of CMY and K, the carriage 31 includes a head 300 for discharging orange ink, a head 30G for discharging green ink, and a head 30B for discharging blue ink. With this configuration, orange ink, green ink, and blue ink are discharged onto the transfer member after the inks of basic colors are discharged. The inks of special colors are discharged onto the transfer member after the inks of basic colors to be used at the same time for color reproduction, regardless of the hues of the image to be formed.

The inks to be added to increase the color reproduction range are not limited to the above-described examples. Red (R) or violet (V) having different hues can be used. The number of inks to be added may be selected depending on the apparatus to be used, and one or more colors may be selected. A plurality of inks having different color materials and having similar hues may also be used. For example, even in the same hue of "green", the hue and brightness/chroma to be realized vary and the color reproduction range varies depending on the color material. A plurality of different inks with similar hues described above may be used. Further, for example, two types of ink, i.e., dark color ink and light color ink, may be used as inks with hues of special colors. The special colors are used to increase the color reproduction range, like in the case of using blue (B) and light blue (Lb).

Figure 8A:
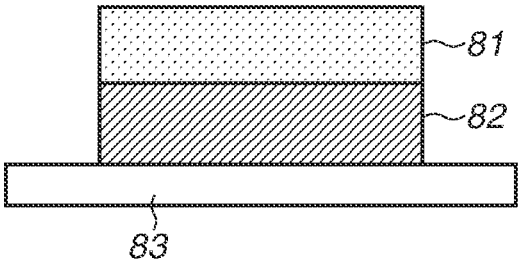
FIG. 8A is a schematic sectional view illustrating an image formation state according to the second exemplary embodiment.
Figure 8B:
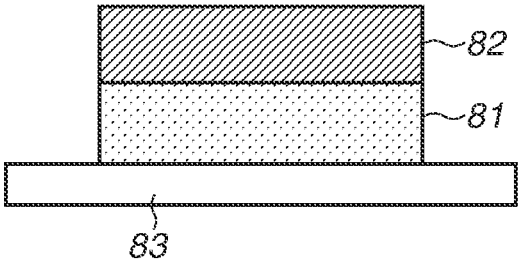
FIG. 8B is a schematic sectional view illustrating an image formation state according to the second exemplary embodiment.

In any of the above-described combinations, inks of basic colors and inks of special colors with hues different from those of the basic colors are formed such that an ink layer with a low color material density is formed as the upper layer. FIGS. 8A and 8B are schematic sectional views each illustrating an image formed by stacking a C ink layer and a G ink layer. FIG. 8A illustrates that a layer 81 is formed using green ink as the upper layer and a layer 82 is formed using cyan ink as the lower layer on a printing medium 83. FIG. 8B illustrates that the layer 82 is formed using cyan ink as the upper layer and the layer 81 is formed using green ink as the lower layer. In FIGS. 8A and 8B, the amount of G ink and the amount of C ink are the same. In the present exemplary embodiment, the color material density of C ink is 4 weight %, and the color material density of G ink is 3 weight %. When the color development layer of the G ink layer with a low color material density is formed as the upper layer, the upper layer has a low scattering intensity and a high transmittance. The color of the C ink layer formed as the lower layer can be satisfactorily developed, accordingly. Comparing FIG. 8A with FIG. 8B, in a state where the layer 81 is formed using green ink as the upper layer and the layer 81 is formed using cyan ink as the lower layer as illustrated in FIG. 8A, an excellent image with an excellent color balance can be obtained as compared to the state illustrated in FIG. 8B.

Even in the present exemplary embodiment, the reaction liquid is coated on the transfer member, and inks are applied onto the transfer member to form ink layers on the transfer member. The ink layers are then transferred onto the printing medium. To form an ink layer of a special color other than the basic colors is formed as the upper layer on the printing medium, the ink of the special color is therefore applied onto the transfer member before the ink layer of the basic colors are applied.

Third Exemplary Embodiment

In a case of an inkjet printing apparatus, part of ink discharged from a head disposed at the upstream side cannot reach a printing surface, so that small droplets of ink mist may float. For example, an air flow caused by the discharged medium (corresponding to the transfer cylinder 41 described in the first exemplary embodiment) moving in a movement direction can move the mist forward, so that the ink mist may adhere to a head disposed at the downstream side. Thus, in a configuration in which ink heads for the same type of colors are arranged close to each other, the mist is less conspicuous even when the mist is present on the heads, so that an excellent image can be printed in many cases.

Figure 9:
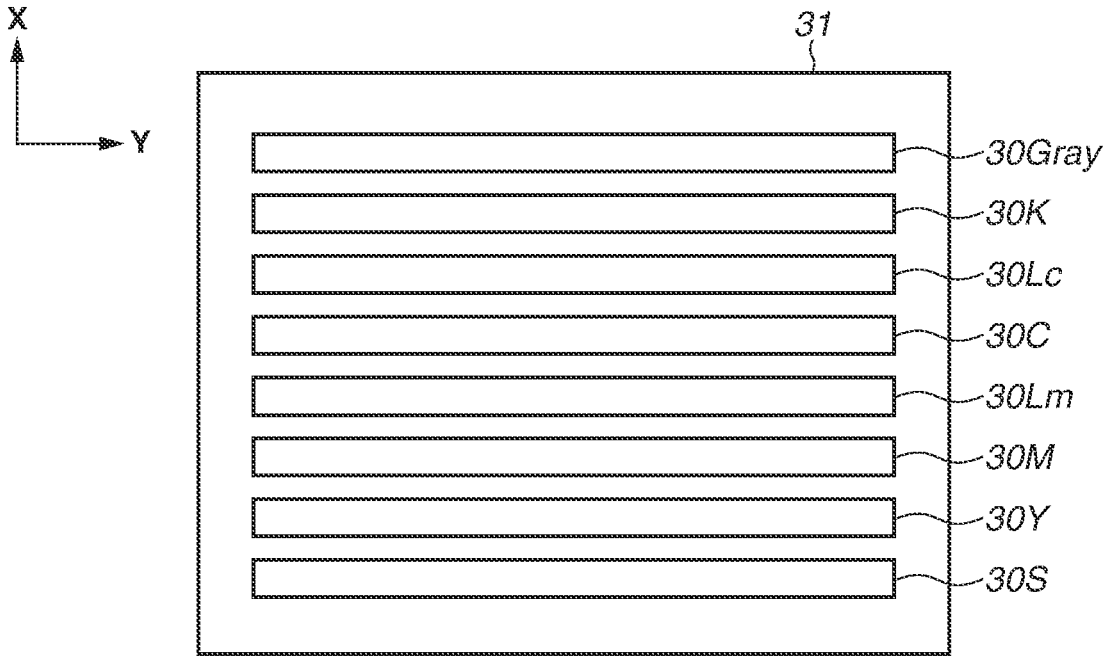
FIG. 9 illustrates a printhead according to a third exemplary embodiment.

A printing system according to a third exemplary embodiment has the same configuration as the printing system according to the first exemplary embodiment. The printing system uses not only inks of basic colors of CMY and K, but also light-color inks of Lc, Lm, and Gray. FIG. 9 illustrates a configuration of a printhead that can be applied to the present exemplary embodiment. The configuration is similar to the configurations illustrated in FIGS. 2 and 7. Similar to the first and second exemplary embodiments, the carriage 31 includes eight printheads. The carriage 31 includes a head 30Gray for discharging gray ink, a head 30K for discharging K ink, a head 30Lc for discharging Lc ink, a head 30C for discharging C ink, a head 30Lm for discharging Lm ink, a head 30M for discharging M ink, a head 30Y for discharging Y ink, and a head 30S for discharging the image transfer liquid. In this configuration, ink heads for the same type of colors are arranged close to each other. For example, the head 30Lc and the head 30C are arranged adjacent to each other and the head 30Lm and the head 30M are arranged adjacent to each other. With this configuration, an ink layer having the same type of color and having a low color material density can be formed as the upper layer and an ink layer having a high color material density can be formed as the lower layer.

For example, as bright cyan color, which is close to white, is mainly composed of light cyan and cyan, the same type of colors are often used together. The use of a plurality of inks at the same time as described above is advantageous in, especially, forming the color development layer formed of an ink layer with a low color material density as the upper layer. The color development layer formed of an ink layer with a low color material density has a low scattering intensity in the color material and has a high transmittance in the color development layer, and the color of the color development layer in the lower layer can be satisfactorily developed as described above in the first exemplary embodiment.

Other Exemplary Embodiments

The present invention can also be applied to a printing apparatus that uses a method other than the transfer method. A printing apparatus having the following configuration can also be used: a line head is used to form ink layers while inks are dried and cured one by one in the order of application and a color material layer is formed on a paper plane. In a case of using such a printing apparatus, the basic color layer formed as the lower layer is applied onto the paper plane to thereby form the color development layer, and light color ink is then applied onto the color development layer to form the color development layer of light color ink. In any case, the color development layer using ink with a low color material density is formed as the upper layer, thereby obtaining the same advantageous effects of those of the first to third exemplary embodiments described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A printing apparatus comprising:

a transfer member configured to pass through a formation area for an ink image and a transfer area;

a printing unit configured to discharge a plurality of different pigmented inks onto the transfer member in the formation area and form the ink image on the transfer member;

a processing unit configured to perform processing for promoting layer formation for each of the plurality of pigmented inks to be applied such that each of the plurality of pigmented inks discharged by the printing unit and applied onto the transfer member forms a layer;

a conveyance unit configured to convey a printing medium; and a transfer unit configured to transfer the ink image from the transfer member onto the printing medium conveyed by the conveyance unit, wherein the plurality of pigmented inks includes cyan ink, magenta ink, yellow ink, and black ink as pigmented inks of basic colors, and at least one pigmented ink different from the pigmented inks of the basic colors, wherein a first ink is applied onto the transfer member after a second ink is applied such that the first ink forms a first ink layer on a second ink layer formed by the second ink, and wherein the first ink is at least one of the pigmented inks of the basic colors, the second ink is the pigmented ink different from the pigmented inks of the basic colors and has a color material density lower than the color material density of the first ink such that the second ink layer has a lower color material density than the first ink layer.

2. The printing apparatus according to claim 1, wherein the at least one pigmented ink different from the pigmented inks of the basic colors includes a light cyan ink having a same type of color as the cyan ink, and having a color material density lower than the color material density of the cyan ink, and a light magenta ink having a same type of color as the magenta ink, and having a color material density lower than the color material density of the magenta ink.

3. The printing apparatus according to claim 1, wherein the at least one pigmented ink different from the pigmented inks of the basic colors includes a plurality of inks having hues different from the basic colors.

4. The printing apparatus according to claim 3, wherein the plurality of inks having hues different from the basic colors includes blue ink and green ink.

5. The printing apparatus according to claim 3, wherein the plurality of inks having hues different from the basic colors includes orange ink.

6. The printing apparatus according to claim 1, wherein the pigmented inks of the basic colors are applied onto the transfer member after any of the at least one pigmented ink different from the pigmented inks of the basic colors is applied.

7. The printing apparatus according to claim 1, wherein the printing unit forms the ink image on the transfer member by discharging ink onto the transfer member during a period in which the transfer member passes through the formation area once.

8. The printing apparatus according to claim 1, wherein the processing unit is an application unit configured to apply liquid for causing the pigment to aggregate on the transfer member before the plurality of pigmented inks is applied by the printing unit.

9. The printing apparatus according to claim 1, wherein the processing unit is a liquid absorption unit configured to absorb liquid contained in the ink image from the ink image.

10. A printing apparatus comprising:

a printing unit configured to discharge a plurality of pigmented inks onto a printing medium and form an ink image on the printing medium; and a processing unit configured to perform processing for promoting layer formation for each of the plurality of pigmented inks to be applied such that each of the plurality of pigmented inks forms a layer every time one ink is discharged by the printing unit and applied onto the printing medium, wherein the plurality of pigmented inks includes cyan ink, magenta ink, yellow ink, and black ink as pigmented inks of basic colors, and at least one pigmented ink different from the pigmented inks of the basic colors, wherein a first ink is applied onto the printing medium before a second ink is applied such that the first ink forms a first ink layer on a second ink layer formed by the second ink, and wherein the first ink is at least one of the pigmented inks of the basic colors, the second ink is the pigmented ink different from the pigmented inks of the basic colors and has a color material density lower than the color material density of the first ink such that the second ink layer has a lower color material density than the first ink layer.

11. A printing method comprising:

discharging a plurality of different pigmented inks onto a transfer member in a formation area and forming an ink image on the transfer member, the transfer member being configured to pass through the formation area for the ink image and a transfer area;

performing processing for promoting layer formation for each of the plurality of pigmented inks to be applied such that each of the plurality of pigmented inks applied onto the transfer member forms a layer; and transferring the ink image from the transfer member onto a printing medium conveyed by a conveyance unit, wherein the plurality of pigmented inks includes cyan ink, magenta ink, yellow ink, and black ink as pigmented inks of basic colors, and at least one pigmented ink different from the pigmented inks of the basic colors, wherein a first ink is applied onto the transfer member after a second ink is applied such that the first ink forms a first ink layer on a second ink layer formed by the second ink, and wherein the first ink is at least one of the pigmented inks of the basic colors, the second ink is the pigmented ink different from the pigmented inks of the basic colors and has a color material density lower than the color material density of the first ink such that the second ink layer has a lower color material density than the first ink layer.

* * * * *